US010214888B2

(12) United States Patent
Doyle et al.

(10) Patent No.: US 10,214,888 B2
(45) Date of Patent: Feb. 26, 2019

(54) DEVICE FOR SUPPLYING A PRODUCT INSIDE A TOILET BOWL

(71) Applicant: ZOBELE ESPAÑA, S.A., Barcelona (ES)

(72) Inventors: Dominic Doyle, Barcelona (ES); Fernando Mayor Sans, Barcelona (ES); Julio Cesar Ruiz Ballesteros, Barcelona (ES); Joaquin Llorente Alonso, Barcelona (ES)

(73) Assignee: ZOBELLE ESPANA, S.A., Barcelona (ES)

( * ) Notice: Subject to any disclaimer, the term of this patent is extended or adjusted under 35 U.S.C. 154(b) by 0 days.

(21) Appl. No.: 15/102,212

(22) PCT Filed: Dec. 4, 2014

(86) PCT No.: PCT/ES2014/070896
§ 371 (c)(1),
(2) Date: Jun. 6, 2016

(87) PCT Pub. No.: WO2015/082748
PCT Pub. Date: Jun. 11, 2015

(65) Prior Publication Data

US 2016/0312455 A1 Oct. 27, 2016

(30) Foreign Application Priority Data

Dec. 5, 2013 (ES) ..... 201331779

(51) Int. Cl.
*E03D 9/02* (2006.01)
*E03D 9/03* (2006.01)

(52) U.S. Cl.
CPC ..... *E03D 9/032* (2013.01); *E03D 2009/028* (2013.01)

(58) Field of Classification Search
CPC ..... E03D 9/005; E03D 9/003; E03D 9/032; E03D 9/037; E03D 2009/028
(Continued)

(56) References Cited

U.S. PATENT DOCUMENTS 1,928,483 A * 9/1933 Gerome ..... E03D 9/037 4/227.3
2,520,056 A * 8/1950 Pozun ..... E03D 9/037 222/187

(Continued)

FOREIGN PATENT DOCUMENTS

DE 100 25 972 A1 12/2001
DE 10025972 A1 * 12/2001 ..... E03D 9/032

(Continued)

OTHER PUBLICATIONS

International Search Report issued by the International Searching Authority (ISA/O.E.P.M.) dated Feb. 18, 2015in connection with International Application No. PCT/ES2014/070896.

(Continued)

*Primary Examiner* — Erin Deery
(74) *Attorney, Agent, or Firm* — Gary J. Gershik; Cooper & Dunham LLP

(57) ABSTRACT

The device includes a replaceable reservoir (1) of a product, and a predetermined quantity of the product is supplied to an interior of a toilet bowl. The device includes first (3) and second (4) housings, interconnected therebetween, the first housing (3) being connected to the replaceable reservoir (1) and mixing the toilet flush water and the product in the second housing (4). The device further includes a valve (5) movable between two positions, including a position in which the communication between said first and second housings (3, 4) is closed and a position in which the communication between the first and second housings (3, 4) is open. The device makes it possible to dose a predeter- (Continued)

mined quantity of product mixed with the toilet flush water in the interior of a toilet bowl.

20 Claims, 2 Drawing Sheets

(58) Field of Classification Search
USPC ..... 4/223, 224, 225.1, 226.1, 227.1, 227.2, 4/227.3, 227.4, 231
See application file for complete search history.

(56) References Cited

U.S. PATENT DOCUMENTS 3,727,632 A * 4/1973 Pansini ..... C02F 1/686 137/268
3,946,448 A * 3/1976 Sioufy ..... E03D 9/032 4/223
4,534,071 A * 8/1985 Russomanno ..... E03D 9/037 4/222
6,496,987 B1 12/2002 Chou
2004/0216221 A1 11/2004 Chen
2006/0123528 A1 6/2006 Pagani
2007/0006369 A1* 1/2007 Sagy ..... E03D 9/037 4/227.1

FOREIGN PATENT DOCUMENTS

EP 0 538 957 A1 4/1993
EP 1 408 164 A2 4/2004
ES 2142777 5/2000
JP 2005 290867 A 10/2005
WO WO 01/04428 A1 1/2001
WO WO 0196676 A1 * 12/2001 ..... E03D 9/037

OTHER PUBLICATIONS

Supplementary European Search Report issued by the European Patent Office dated Jun. 21, 2017 in connection with European Patent Application No. EP 14 86 8180.

* cited by examiner

DEVICE FOR SUPPLYING A PRODUCT INSIDE A TOILET BOWL

RELATED APPLICATIONS

This application is a § 371 national stage of PCT International Application No. PCT/ES2014/070896, filed Dec. 4, 2014, claiming priority of Spanish Patent Application P201331779, filed Dec. 5, 2013, the contents of each of which are hereby incorporated by reference into this application.

The present invention relates to a device for supplying a product to the interior of a toilet bowl, for example, to supply a liquid disinfectant whenever the toilet is flushed.

BACKGROUND OF THE INVENTION

The use of devices in toilets that supply a product, for example a disinfectant, to the interior of a toilet bowl whenever the toilet is flushed is common practice. These devices are aimed at ensuring that the toilet bowl is always as clean as possible. Other types of substances which are normally used with these devices are soaps, perfumes, anti-lime, bleach, etc.

These devices are usually arranged on the upper rim of the toilet bowl, such that the product remains in the interior of the bowl, which comes into contact with the water when it is flushed.

A drawback of these traditional devices is that it is not possible to control the quantity of product supplied to the interior of the toilet bowl, since it does not comprise any dosage control system.

Additionally, these traditional devices cannot guarantee the prevention of product leaks when water is not discharged into the interior of the toilet bowl.

Therefore, the need for a device that makes it possible to supply a predetermined quantity of product to the interior of the toilet bowl to ensure that it is adequately cleaned and also to prevent accidental leaks when water is not discharged into the interior of the toilet bowl.

DESCRIPTION OF THE INVENTION

The supply device of the invention resolves the aforementioned drawbacks and has other advantages that will be described below.

The device for supplying a product to the interior of a toilet bowl in accordance with the present invention comprises a replaceable reservoir of said product and is characterised in that it comprises dosing means connected to said replaceable reservoir for supplying a predetermined quantity of said product to the interior of a toilet bowl.

This characteristic allows the device of the present invention to dose a predetermined quantity of product into the interior of a toilet bowl mixed with the toilet flush water, said quantity being sufficient to adequately clean the interior of the toilet bowl.

According to a preferred embodiment, said dosing means comprise:

- first and second interconnected housings, said first housing being connected to said replaceable reservoir and wherein the toilet flush water and said product are mixed in said second housing; and
- a valve movable between two positions: a position wherein the communication between said first and second housings is closed and a position wherein the communication between said first and second housings is open.

Advantageously, said second housing comprises holes, at least one of which is destined for the inflow of toilet flush water and at least one of which is destined for the outflow of water mixed with said product, and said movable valve, in its closed position, also closes said at least one of the holes for the outflow of water mixed with said product.

Preferably, said at least one hole for the inflow of toilet flush water is provided in the upper portion of said second housing in the use position of the device and said at least one hole for the outflow of water mixed with said product is arranged on the lower portion of said second housing in the use position of the device.

Additionally, said valve is advantageously provided of a material that floats on water, such as plastic.

Preferably, said valve comprises a pad provided of porous material, which in the closed position of said valve closes the communication between said first and second housings, and said dosing means are connected to said replaceable reservoir by means of a strip of absorbent material.

According to a preferred embodiment, said valve comprises a first shutter that closes the communication between said housings in its closed position and a second shutter that closes said at least one of the holes for the outflow of water mixed with said product in its closed position.

BRIEF DESCRIPTION OF THE DRAWINGS

In order to help make the characteristics of the invention more readily understandable, the description is accompanied by a set of drawings, which, by way of illustration and not limitation, represent a practical case of embodiment.

DESCRIPTION OF A PREFERRED EMBODIMENT

Figure 1:
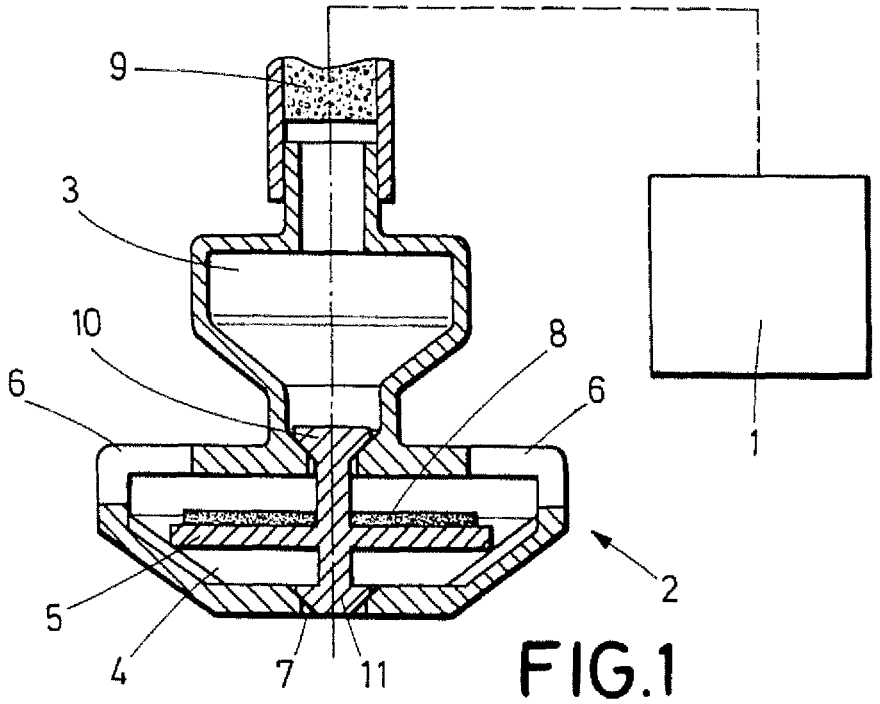
FIG. 1 shows a schematic view of the supply device of the present invention, wherein the dosing means are represented in cross-section in their resting position prior to the use of the supply device.

FIG. 1 schematically represents the device for supplying a product to the interior of a toilet bowl, which comprises a replaceable reservoir 1 and dosing means 2, which are interconnected.

Said replaceable reservoir 1 comprises, in its interior, the product that must be supplied to the toilet bowl whenever the toilet is flushed and said reservoir 1 may be arranged in the interior or exterior of said toilet bowl.

Preferably, the communication between the reservoir 1 and the dosing means 2 is carried out by means of a strip 9 of absorbent material, although it may be carried out by means of any adequate means currently known in the art.

In the case that the replaceable reservoir 1 is arranged outside of the toilet bowl, the strip 9 of absorbent material would be sufficiently long to ensure the supply of the dosing means 2, which would be inside the bowl.

It should be noted that, for the sake of simplicity, said replaceable reservoir 1 has not been represented in the rest of the figures.

The dosing means 2 comprise a first housing 3 and a second housing 4, interconnected therebetween. Said first housing 3 firstly receives the product from said reservoir 1, while the second housing 4 is used to discharge the mixture of the product with the toilet water, as will be described later.

Said first housing 3 is open at the top to receive the product, for example through a wick 9, and said second housing 4 comprises various holes 6, 7.

In accordance with the represented embodiment, the second housing 4 comprises holes 6 provided in the upper portion thereof. At least one of these holes 6 serves to allow the inflow of water from the toilet to said second housing 4 when it is flushed, and at least another of these housings 6 serves to allow the outflow of the water and product mixture.

Additionally, the second housing 4 also comprises at least one hole 7 provided in the lower portion thereof for the outflow of the water and product mixture when the toilet is flushed.

Said dosing means 2 also comprise a valve 5 arranged between said first 3 and second 4 housings and serves to regulate the passage of the product from the first to the second housings 3, 4 and to regulate the outflow of the product mixed with water to the interior of the toilet bowl.

Said valve 5 is movable between a closed position (represented in FIGS. 2 to 3), wherein the communication between said housings 3, 4 is closed, and an open position (represented in FIG. 4), wherein the communication between said housings 3, 4 is open.

Said valve 5 comprises a first shutter 10 that closes the communication between said housings 3, 4 in its closed position and a second shutter 11, which closes at least one hole 7 provided in the lower portion of said second housing 4.

In order to guarantee watertightness, said valve 5 also comprises a pad provided of porous material 8, which, in the closed valve position 5, is in contact with and seals the connection zone between the first 3 and second 4 housings.

As will be explained below, in order to enable the movement of the valve 5 from its closed position to its open position, the valve 5 is provided of material that floats on water, for example, plastic.

Figure 2:
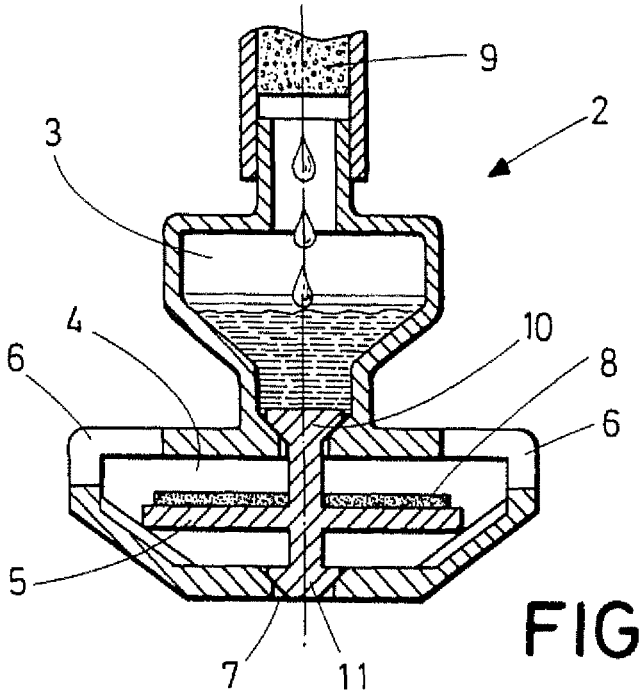
FIGS. 2 to 4 are schematic views of said dosing means represented in cross section during the different phases of their use.

The operation of the supply device in accordance with the present invention is as follows:

The product stemming from the replaceable reservoir 1 is transported to the interior of said first housing 3, for example by means of the wick 9 represented in the drawings or by any adequate means, as represented in FIG. 2.

Figure 3:
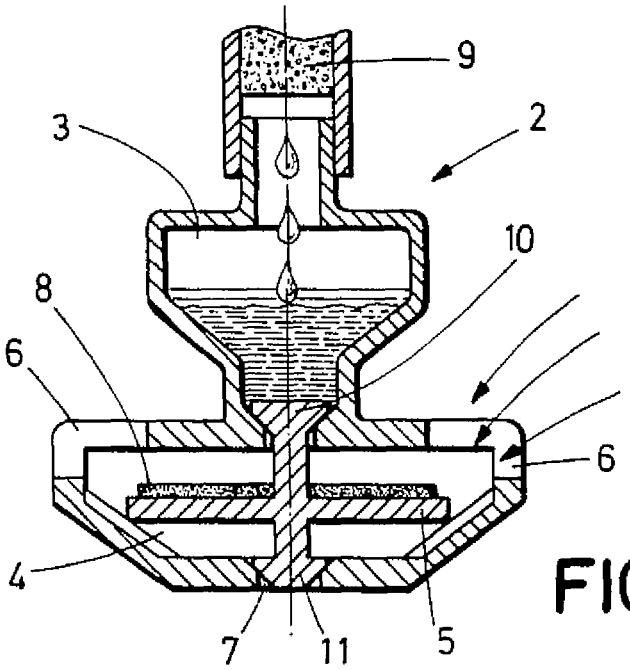

When a user triggers the discharge of water in the toilet, the water that falls into the interior of the toilet bowl enters the second housing 4 through the at least one of the holes 6 provided in the upper portion thereof, as represented in FIG. 3.

Figure 4:
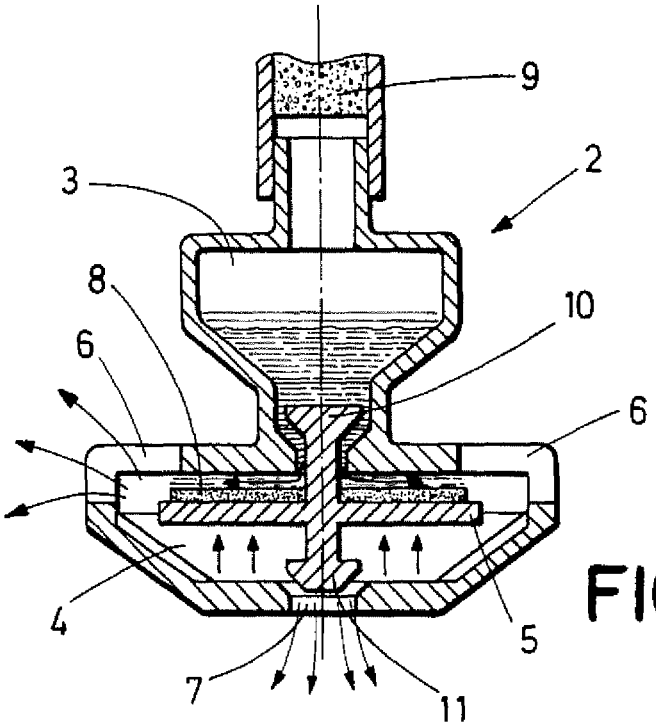

This water beings to accumulate in the interior of the second housing 4, until reaching a level such as to displace the valve 5, rising from its closed position to its open position due to the fact that the valve 5 floats on the water, as represented in FIG. 4.

When the valve 5 is in the open position, the first shutter 10 ceases to close the communication between the first housing 3 and the second housing 4, such that the product contained in said first housing 3 passes to the second housing 4 by means of gravity and is mixed with the water contained therein. At the same time, the second shutter 11 ceases to close the hole 7 provided in the lower portion of the second housing 4, such that the water mixed with the product is supplied to the interior of the toilet bowl. Additionally, the water mixed with the product also flows out of at least one of the holes 6 provided in the upper portion of said second housing 4, as can be observed in FIG. 4. As the water contained in the second housing 4 is discharged, the valve 5 will move towards its closed position until completely closing the communication between the two housings 3, 4, restarting the described operating cycle.

Despite the fact that reference has been provided to a specific embodiment of the invention, it is evident for the person skilled in the art that the described supply device is susceptible of numerous variations and modifications, and that all the aforementioned details may be replaced by other, technically equivalent ones, without detracting from the scope of protection defined by the attached claims.

The invention claimed is:

1. A device for supplying a product to an interior of a toilet bowl, the device comprising:

a replaceable reservoir (1) of said product; and a dosing means (2) connected to said replaceable reservoir (1) for supplying a predetermined quantity of said product to the interior of the toilet bowl, said dosing means (2) including a first housing (3) and a second housing (4), interconnected therebetween, said first housing (3) being connected to said replaceable reservoir (1) and said second housing (4) holding a mixture of toilet flush water and said product therein; and a valve movable between (i) an open position to allow for outflow from the second housing (4) of the mixture of the toilet flush water and said product and (ii) a closed position in which the outflow of the mixture held in the second housing (4) is not permitted, wherein in the closed position of the valve (5), fluid communication between said first and second housings (3, 4) is closed, and in the open position of the valve (5), fluid communication between said first and second housings (3, 4) is open.

2. The device, according to claim 1, wherein said second housing (4) includes at least one first hole (6) and at least one second hole (7), said at least one first hole (6) allowing for inflow of the toilet flush water into said second housing (4), and said at least one second hole (7) allowing for the outflow of the mixture from said second housing (4).

3. The device, according to claim 2, wherein said valve (5) comprises a first shutter (10) that closes the communication between said first and second housings (3, 4) in the closed position and a second shutter (11) that closes said at least one second hole (7) for the outflow of the mixture of toilet flush water and said product in the closed position.

4. The device, according to claim 3, wherein said dosing means (2) is arranged in the interior of the toilet bowl and said replaceable reservoir (1) is arranged in the exterior of the toilet bowl.

5. The device, according to claim 2, wherein said dosing means (2) is arranged in the interior of the toilet bowl and said replaceable reservoir (1) is arranged in the exterior of the toilet bowl.

6. The device, according to claim 2, wherein said movable valve (5), in the closed position, also closes said at least one second hole (7), to prevent the outflow of the mixture held in said second housing (4).

7. The device, according to claim 1, wherein said dosing means (2) is arranged in the interior of the toilet bowl and said replaceable reservoir (1) is arranged in the exterior of the toilet bowl.

8. The device, in accordance with claim 6, wherein said valve (5) is made of a material that floats on water.

9. The device, according to claim 8, wherein said valve (5) is made of plastic.

10. The device, according to claim 6, wherein said valve (5) includes a pad (8) of porous material disposed thereon.

11. The device, according to claim 6, wherein said at least one first hole (6) for the inflow of the toilet flush water is provided in an upper portion of said second housing (4) in a use position of the device and said at least one second hole (7) for the outflow of the mixture of toilet flush water and said product is provided in a lower portion of said second housing (4) in the use position of the device.

12. The device, according to claim 6, wherein said valve (5) comprises a first shutter (10) that closes the communication between said first and second housings (3, 4) in the closed position and a second shutter (11) that closes said at least one second hole (7) for the outflow of the mixture of toilet flush water and said product in the closed position.

13. The device, according to claim 2, wherein said at least one first hole (6) for the inflow of the toilet flush water is provided in an upper portion of said second housing (4) in a use position of the device and said at least one second hole (7) for the outflow of the mixture of toilet flush water and said product is provided in a lower portion of said second housing (4) in the use position of the device.

14. The device, according to claim 13, wherein said dosing means (2) is arranged in the interior of the toilet bowl and said replaceable reservoir (1) is arranged in the exterior of the toilet bowl.

15. The device, in accordance with claim 1, wherein said valve (5) is made of a material that floats on water.

16. The device, according to claim 15, wherein said valve (5) is made of plastic.

17. The device, according to claim 1, wherein said valve (5) includes a pad (8) of porous material disposed thereon.

18. The device, according to claim 1, wherein said dosing means (2) is connected to said replaceable reservoir (1) via a strip (9) of absorbent material.

19. The device, according to claim 18, wherein said dosing means (2) is arranged in the interior of the toilet bowl and said replaceable reservoir (1) is arranged in the exterior of the toilet bowl.

20. The device, according to claim 1, wherein said dosing means (2) is arranged in the interior of the toilet bowl and said replaceable reservoir (1) is arranged in the exterior of the toilet bowl.

* * * * *